US010661927B2

(12) United States Patent
Uemoto et al.

(10) Patent No.: US 10,661,927 B2
(45) Date of Patent: May 26, 2020

(54) WIRE INSERTING DEVICE, ELONGATED WORKPIECE WINDING APPARATUS AND WIRE INSERTING METHOD

(71) Applicant: NETUREN CO., LTD., Tokyo (JP)

(72) Inventors: Toshifumi Uemoto, Tokyo (JP); Tsuyoshi Yamashita, Tokyo (JP)

(73) Assignee: NETUREN CO., LTD., Tokyo (JP)

( * ) Notice: Subject to any disclaimer, the term of this patent is extended or adjusted under 35 U.S.C. 154(b) by 747 days.

(21) Appl. No.: 15/109,221

(22) PCT Filed: Jan. 29, 2015

(86) PCT No.: PCT/JP2015/053159

§ 371 (c)(1),
(2) Date: Jun. 30, 2016

(87) PCT Pub. No.: WO2015/115671

PCT Pub. Date: Aug. 6, 2015

(65) Prior Publication Data

US 2016/0325861 A1 Nov. 10, 2016

(30) Foreign Application Priority Data

Jan. 29, 2014 (JP) ..... 2014-014972

(51) Int. Cl.
*B65B 27/06* (2006.01)
*B65B 13/02* (2006.01)
(Continued)

(52) U.S. Cl.
CPC ..... *B65B 27/06* (2013.01); *B65B 13/02* (2013.01); *B65B 57/12* (2013.01); *B65H 54/62* (2013.01);
(Continued)

(58) Field of Classification Search
CPC ..... B21F 15/00; B21F 15/02; B21F 23/00; B65B 13/02; B65B 13/04; B65B 13/06;
(Continued)

(56) References Cited

U.S. PATENT DOCUMENTS 2,693,219 A * 11/1954 Heller ..... B21F 1/02 140/147
3,263,597 A * 8/1966 Stychinsky ..... B65B 27/06 100/10
(Continued)

FOREIGN PATENT DOCUMENTS

JP 9-188306 7/1997

OTHER PUBLICATIONS

International Search Report dated Apr. 9, 2015 in International Application No. PCT/JP2015/053159.

*Primary Examiner* — Edward T Tolan
(74) *Attorney, Agent, or Firm* — Wenderoth, Lind & Ponack, L.L.P.

(57) ABSTRACT

A wire inserting device, an elongated workpiece winding apparatus having the wire inserting device, and a wire inserting method are provided to insert a wire in a bundle of an elongated workpiece at an intermediate point in the bundle. The wire inserting device includes a detector arranged at a position corresponding to the intermediate point, and a wire holder configured to releasably hold the wire. The detector is configured to move when pushed by the elongated workpiece placed at the intermediate point during a formation of the bundle of the elongated workpiece. The wire holder is configured to move in synchronization with the detector to insert the wire in the bundle at the intermediate point.

8 Claims, 3 Drawing Sheets

(51) Int. Cl.

| | |
|---|---|
| ***B65H 54/62*** | (2006.01) |
| ***B65H 65/00*** | (2006.01) |
| ***B65H 75/28*** | (2006.01) |
| ***B65B 57/12*** | (2006.01) |

(52) U.S. Cl.
CPC ..... *B65H 65/005* (2013.01); *B65H 75/28* (2013.01); *B65H 2701/36* (2013.01)

(58) Field of Classification Search
CPC ..... B65B 27/06; B65B 57/12; B65H 54/62; B65H 2701/361; B65H 65/005
See application file for complete search history.

(56) References Cited

U.S. PATENT DOCUMENTS

| | | | | | |
|---|---|---|---|---|---|
| 3,470,813 | A * | 10/1969 | Nomm | B65B 13/06 | 100/26 |
| 3,662,678 | A * | 5/1972 | Johnson | B65B 27/06 | 100/4 |
| 3,889,584 | A * | 6/1975 | Wiklund | B65B 27/06 | 100/26 |
| 4,084,420 | A * | 4/1978 | Tsutsumino | B21F 3/04 | 72/138 |
| 4,362,038 | A * | 12/1982 | Katahira | B21F 3/04 | 72/130 |
| 4,388,952 | A * | 6/1983 | Hamane | H02K 15/0457 | 140/92.1 |
| 5,540,142 | A * | 7/1996 | Mieleszuk | B65B 13/06 | 100/12 |
| 2003/0121424 | A1 * | 7/2003 | Doyle | B65B 13/06 | 100/29 |

* cited by examiner

WIRE INSERTING DEVICE, ELONGATED WORKPIECE WINDING APPARATUS AND WIRE INSERTING METHOD

TECHNICAL FIELD

The present invention relates to a ire inserting device for inserting a wire in a bundle of an elongated workpiece at an intermediate point in the bundle, an elongated workpiece winding apparatus including the wire inserting device, and a wire inserting method.

BACKGROUND ART

Conventionally, when forming a coil by winding an elongated workpiece a number of times into a bundle, a binding wire is inserted in the bundle of the elongated workpiece at an intermediate winding point of the bundle to bind a portion of the elongated workpiece. For example, several winds from the end of the elongated workpiece are bound together to stably hold the shape of the coil.

According to a related art, when forming a wire rod coil by spirally winding an elongated wire rod a number of times, in order to prevent from collapsing, a binding tape is inserted in the middle of the wire rod coil and only an upper portion of the wire rod coil is bound by the binding tape (see, e.g., JP H09-188306 A). Here, an automatic inserting device for the wire rod coil binding tape is configured by combining various means.

However, the related automatic inserting device is costly due to its complicated structure. Therefore, the inserting device cannot be mounted on a simple apparatus. Sometimes, a worker manually inserts a binding wire in a bundle of an elongated workpiece at an intermediate winding point in the bundle of during the winding, so that working efficiency for forming a coil by winding an elongated workpiece a number of times is poor.

SUMMARY OF INVENTION

It is an object of the present mention to provide a wire inserting device capable of easily inserting, with a simple structure, a wire in a bundle of an elongated workpiece at an intermediate point in the bundle, to provide an elongated workpiece winding apparatus using the wire inserting device, and to provide a wire inserting method.

According to an aspect of the present invention, a wire inserting device is provided to insert a wire in a bundle of an elongated workpiece at an intermediate point in the bundle. The wire inserting device includes a detector arranged at a position corresponding to the intermediate point, and a wire holder configured to releasably hold the wire. The detector is configured to move when pushed by the elongated workpiece placed at the intermediate point during a formation of the bundle of the elongated workpiece. The wire holder is configured to move in synchronization with the detector to insert the wire in the bundle at the intermediate point.

According to another aspect of the present invention, a binding wire inserting device is provided to insert a binding wire in a bundle of an elongated workpiece that has been wound multiple times around a drum at an intermediate winding point in the bundle. The binding wire inserting device includes a wire holder swingably supported on the drum. The wire holder is configured to releasably hold the binding wire in a state in which a leading end of the binding wire is protruded from the wire holder and to swing between a first swing position and a second swing position. In the first swing position, the wire holder holds the binding wire such that the leading end of the binding wire is placed on one side of the intermediate winding point. In the second swing position, the wire holder holds the binding wire such that the leading end of the binding wire is placed on the other side of the intermediate winding point.

According to another aspect of the present invention, an elongated workpiece winding apparatus is provided. In the apparatus, the binding wire inserting device is attached to a drum to be rotated to wind an elongated workpiece.

According to another aspect of the present invention, a wire inserting method is provided to insert a wire in a bundle of an elongated workpiece at an intermediate point in the bundle. The wire inserting method includes releasably holding the wire by a wire holder, pushing and moving a detector by the elongated workpiece placed at the intermediate point during a formation of the bundle of the elongated workpiece, the detector being arranged at a position corresponding to the intermediate point, and moving the wire holder in synchronization with the detector to insert the wire at the intermediate point.

According to another aspect of the present invention, a binding wire inserting method is provided to insert a binding wire at an intermediate winding point when winding an elongated workpiece multiple times around a drum to form a bundle of the elongated workpiece. The binding wire inserting method includes releasably holding the binding wire by a wire holder in a state in which a leading end of the binding wire is protruded from the wire holder, the wire holder being swingably supported on the drum, and when the elongated workpiece is placed at the intermediate winding point, swinging the wire holder from a first swing position at which the leading end of the binding wire is placed on one side of the intermediate winding point to a second swing position at which the leading end of the binding wire is placed on the other side of the intermediate winding point.

According to the wire inserting device and the wire inserting method of the present invention, the detector is arranged at a position corresponding to the intermediate point in the bundle of the elongated workpiece. The detector is configured to move when pushed by the elongated workpiece placed at the intermediate point during the formation of the bundle of the elongated workpiece. Accordingly, the detector is reliably operated with a simple configuration. Further, in synchronization with the detector, the wire holder inserts the wire at the intermediate point. Therefore, it is possible to provide the wire inserting device and the wire inserting method, capable of easily inserting, with a simple structure, the wire in the bundle of the elongated workpiece at the intermediate point.

According to the binding wire inserting device and the binding wire inserting method of the present invention, the binding wire is held in the wire holder in a state in which the leading end of the binding wire is protruded from the wire holder, and the wire holder is swung to the second swing position from the first swing position. As a result, the leading end of the binding wire is moved from one side to the other side of the intermediate winding point. Therefore, when winding the elongated workpiece multiple times around the drum, the wire holder is held in the first swing position until the elongated workpiece reaches the intermediate winding point. Then, the wire bolder is swung to the second swing position when the elongated workpiece reaches the intermediate winding point. In this way, the binding wire is easily inserted at the intermediate winding point of the elongated workpiece that has been wound. Accordingly, it is possible to provide the binding wire inserting device and the binding wire inserting method, capable of easily inserting, with a simple structure, the binding wire at the intermediate winding point of the elongated workpiece during the winding. Further, it is possible to provide an elongated workpiece winding apparatus using the binding wire inserting device.

DESCRIPTION OF EMBODIMENTS

Hereinafter, an embodiment of the present invention will be described in detail with reference to the drawings, with an example of a device of forming a coil by winding an elongated workpiece W multiple times, the elongated workpiece W being made of a steel rod having a circular cross-section.

Figure 1:
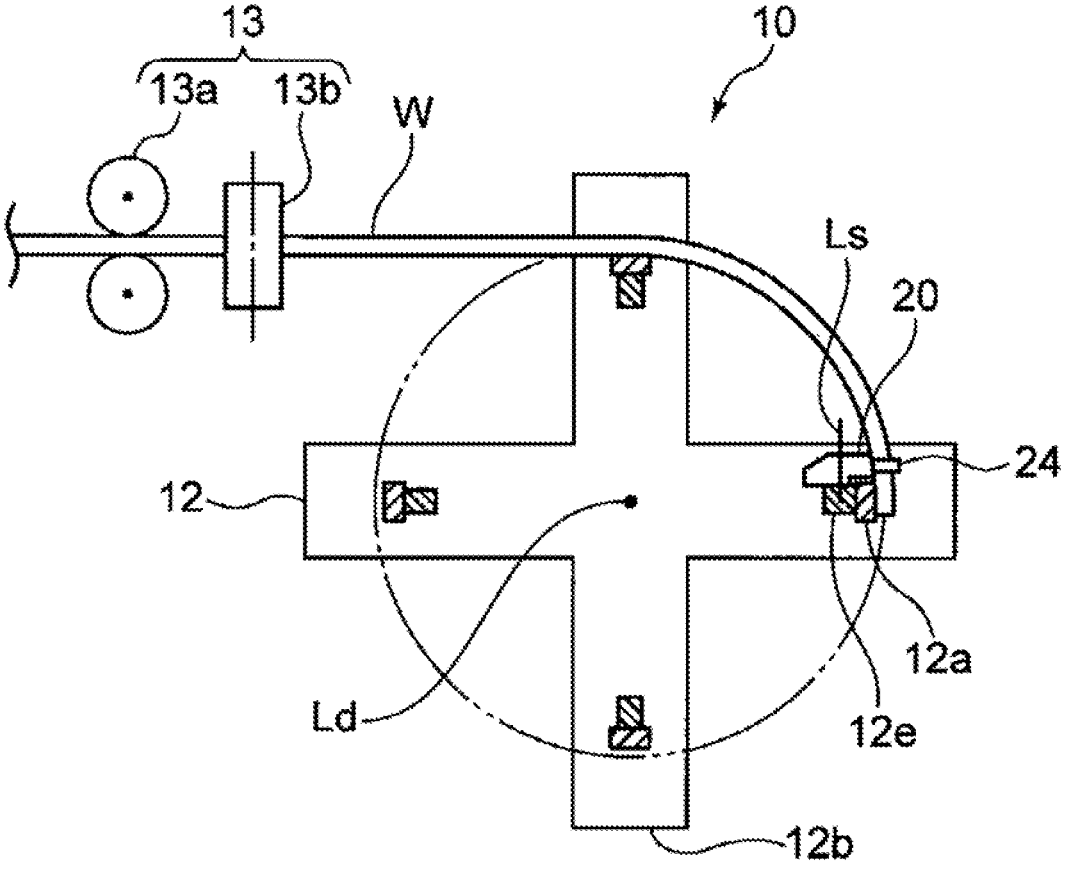
FIG. 1 is a schematic front view of an elongated workpiece winding apparatus according to an embodiment of the present invention.
Figure 2:
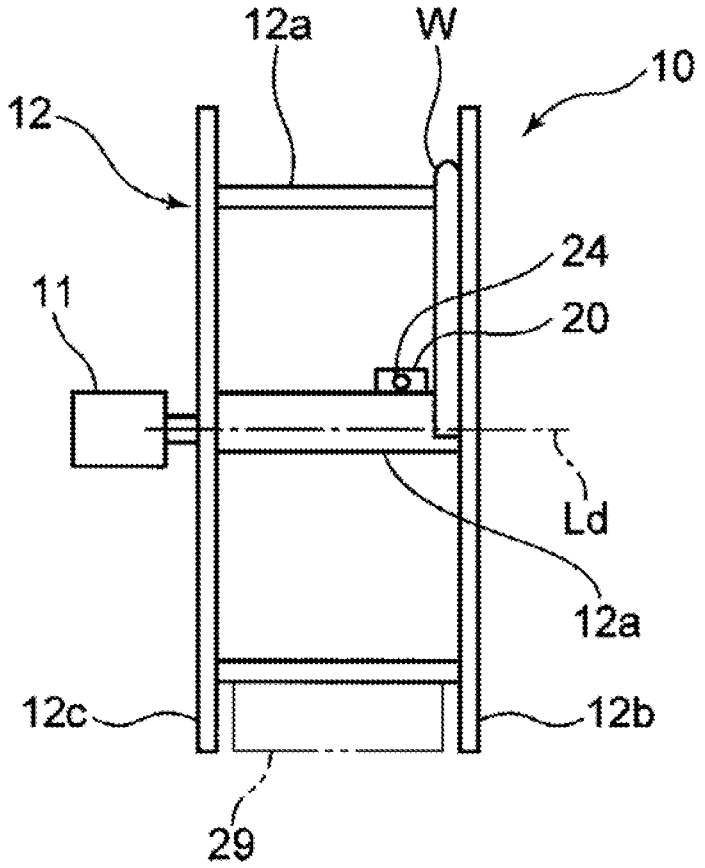
FIG. 2 is a schematic side view of the elongated workpiece winding apparatus.

As shown in FIGS. 1 and 2, an elongated workpiece winding apparatus 10 according to the present embodiment includes a drum 12, a supply device 13, and an inserting device 20. The drum 12 is rotated by a driving device 11 to wind the elongated workpiece W therearound. The supply device 13 is arranged on the upstream of the drum 12, and continuously supplies the elongated workpiece W while adjusting the supplying position relative to the drum 12. The inserting device 20 is attached to the drum 12 insert a binding wire T at an intermediate point in the bundle of the elongated workpiece W that has been wound around the drum 12.

The supply device 13 includes, for example, a plurality of first position adjustment rollers 13*a* and a plurality of second position adjustment rollers 13*b*. The first position adjustment rollers 13*a* are rotated while holding the elongated workpiece W therebetween. The second position adjustment rollers 13*b* are rotated while holding the elongated workpiece W therebetween in a different direction than the first position adjustment rollers 13*a*. Here, the first position adjustment rollers 13*a* are configured to adjust the position of the elongated workpiece W in a radial direction of the drum 12. The second position adjustment rollers 13*b* are configured to adjust the position of the elongated workpiece W in a width direction of the drum 12.

The drum 12 includes a plurality of inner frames 12*a* and a pair of end frames 12*b*, 12*c*. The inner frames 12*a* are provided at plural locations along a circumferential direction, and are arranged parallel to a rotation axis Ld of the drum. The end frames 12*b*, 12*c* are provided at respective ends in the width direction along the rotation axis Ld of the drum. The elongated workpiece W is wound around this drum 12 such that the elongated workpiece W is sequentially arranged and stacked on the outer periphery of the plurality of inner frames 12*a* and between the pair of end frames 12*b*, 12*c*.

The binding wire inserting device 20 is configured to insert the binding wire T at the intermediate winding point Pm in the bundle of the elongated workpiece W that has been wound multiple times around the drum 12. Here, the binding wire T is thinner than the elongated workpiece W. The binding wire T is not particularly limited. For example, an annealed wire made of magnetizable material may be used as the binding wire T. The binding wire T has a length that is sufficient to bind the elongated workpiece W. For example, the binding wire may be cut in advance into a predetermined length.

Figure 3:
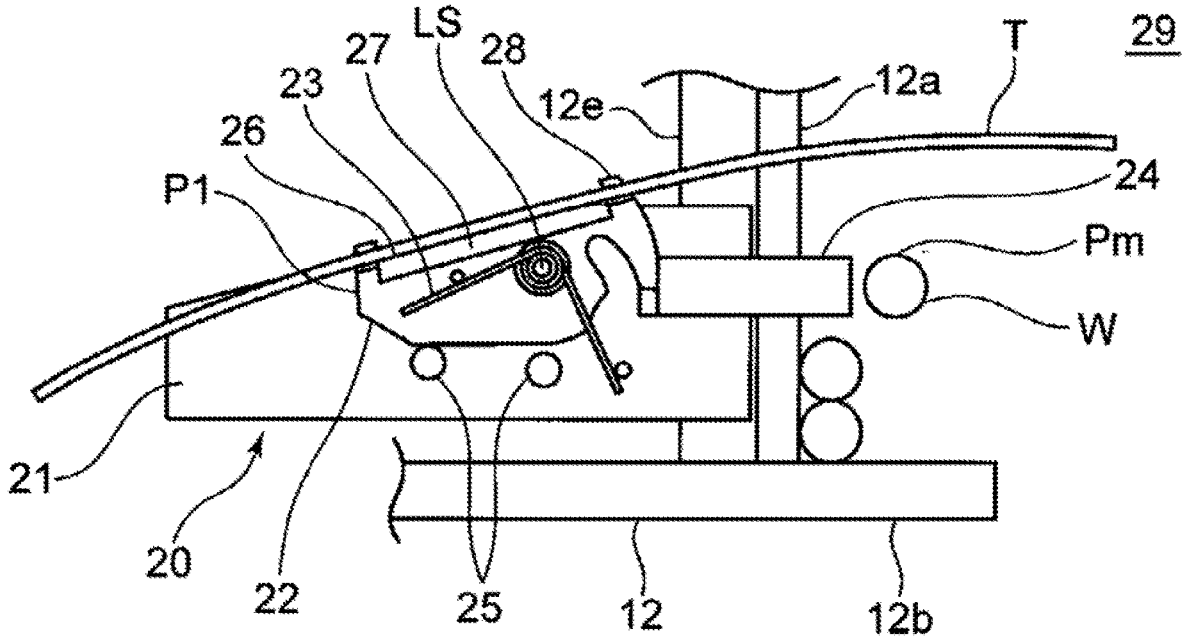
FIG. 3 is a view of a binding wire inserting device according to an embodiment of the present invention, illustrating a state in which a wire holder is in a first swing position.
Figure 4:
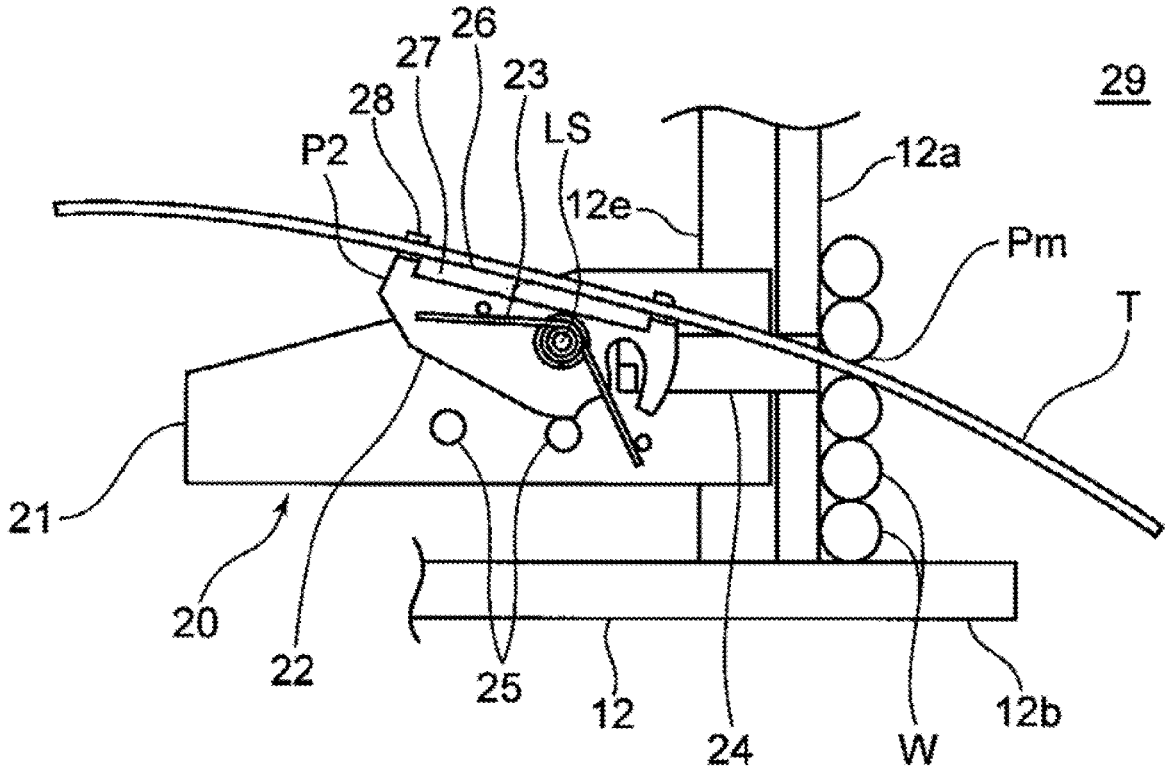
FIG. 4 is a view of the binding wire inserting device, illustrating a state in which the wire holder is in a second swing position.

As shown in FIGS. 3 and 4, the inserting device 20 includes a base member 21 supported on the drum 12, a wire holder 22 swingably supported on the base member 21 and holding the binding wire T, an biasing member 23 biasing the wire holder 22 in a swinging direction, and a detector 24 configured to detect the elongated workpiece W at a predetermined position and to cause the wire holder 22 to swing.

The base member 21 is fixed to a rail member 12*e* attached to the inner frames 12*a* of the drum 12, thereby being placed in an inner peripheral side of the drum. The wire holder 22, the biasing member 23, the detector 24 and the like are arranged on the base member 21.

The rail member 12*e* is fixed to some of the inner frames 12*a*, and is arranged along the rotation shaft Ld of the drum 12, so that the positions of the wire holder 22 and the detector 24 can be adjusted in the width direction of the drum 12 to fix the wire holder 22 and the detector 24 at desired positions.

The wire holder 22 swings in a direction intersecting an axis of the elongated workpiece W to be wound. The wire holder 22 is swingable between a first swing position P1 and a second swing position P2 defined by two stoppers 25 respectively.

As shown in FIGS. 3 and 4, the wire holder 22 includes a holding portion 26 extending in a direction intersecting the swing shaft Ls. The holding portion 26 is configured to releasably hold the binding wire T. That is, the wire holder 22 can swing in a state of holding the binding wire T, and the binding wire T can be released from the holding portion 26 when certain level of pulling force or the like is applied to the binding wire T.

According to the present embodiment, the holding portion 26 includes a magnet 27, so that the binding wire T is held by being magnetically attached to the surface of the holding portion 26. Respective ends of the holding portion 26 in the longitudinal direction of the holding portion 26 are provided with position restricting protrusions 28. The position restricting protrusions 2 are configured as a pair of protruding pieces protruded with a given width so as to restrict the arrangement position of the binding wire T.

When the binding wire T is held in the wire holder 22, the binding wire T is oriented in a direction protruding from an inner peripheral side to an outer peripheral side of the drum 12, such that a leading end of the binding wire T is arranged to protrude into the winding region 29 where the binding wire T is wound around the drum 12.

The holding portion 26 of the wire holder 22 is arranged at a position corresponding to the intermediate winding point Pm of the elongated workpiece W to be wound multiple times, and is adjusted by a position at which the base member 21 is fixed to the rail member 12*e*.

In the example shown in FIGS. 3 and 4, a position where the elongated workpiece W is wound three turns from one of the end frames 12*b* is set as the intermediate winding point Pm. The position of the inserting device 20 is adjusted so that the binding wire T can he inserted at the intermediate winding point Pm.

Upon swinging the wire holder 22, in the first swing position P1 shown in FIG. 3, the leading end of the binding wire T is placed on a side toward the end frame 12*c* from the intermediate winding point Pm, and in the second swing position P2 shown in FIG. 4, the leading end of the binding wire T is placed on a side toward the other end frame 12*b* from the intermediate winding point Pm.

According to this embodiment, a torsion coil spring is attached around the swing shaft Ls to provide the biasing member 23. The torsion coil spring is engaged at a stopper of the base member 21 and at a stopper of the wire holder 22, such that the wire holder 22 is biased toward the second swing position P2.

The detector 24 is supported on the base member 21 so as to be movable in and out in the radial direction. The detector 24 is arranged at a position on the drum 12 corresponding to the intermediate winding point Pm such that the detector 24 can be protruded from the drum and accommodated in the drum. The detector 24 in the protruded state is engaged with a swinging end of the wire holder 22 in the first swing position P1.

The wire holder 22 is configured to swing when the detector 24 detects the elongated workpiece W at the intermediate winding point Pm where the elongated workpiece W is arranged after being wound several times. In this embodiment, the detector 24 is retracted and becomes an accommodated state when the elongated workpiece W to be wound around the drum 12 abuts against the detector 24. In this way, the wire holder 22 and the detector 24 are disengaged, and the wire holder 22 is biased by the biasing member 23 to swing from the first swing position P1 to the second swing position P2.

Next, an operation of the winding apparatus 10 will be described.

First, as shown in FIG. 1, the leading end of the elongated workpiece W is set be being fixed to the drum 12. Here, the end portion of the elongated workpiece W is abutted against the inner frames 12*a* and the end frame 12*b*. Further, the inserting device 20 for inserting the binding wire T is arranged at a position corresponding to the intermediate winding point Pm that has been set in advance.

Then, the wire holder 22 of the inserting device 20 is placed in the first swing position P1, and is engaged with the detector 24. Further, the detector 24 is placed in a protruded state. Furthermore, the binding wire T is magnetically attached to the holding portion 26. In this way, the leading end of the binding wire T is protruded to the winding region 29 and positioned on the side toward the end frame 12*c* from the intermediate winding point Pm.

In this state, the supply device 13 supplies the elongated workpiece W while adjusting the position of the elongated workpiece W in the radial direction and in the width direction, and the drum 12 is rotated by the driving device 11. In this way, the elongated workpiece W is sequentially wound to form a bundle. In this embodiment, the elongated workpiece W is brought into contact with the plurality of inner frames 12*a* and also brought into contact with the previously wound portion of the elongated workpiece W t, so that the elongated workpiece W is sequentially arranged and wound from the position contacting the end frame 12*b* toward the end frame 12*c*.

At the time of this winding, the wire holder 22 of the inserting device 20 is first placed in the first swing position P1. Accordingly, the binding wire T is placed at a position where the binding wire T does not contact the elongated workpiece W to be wound.

Then, the elongated workpiece W to be supplied is sequentially arranged and wound while being brought into contact with the plurality of inner frames 12*a* and also brought into contact with the previously wound portion of the elongated workpiece W. When the elongated workpiece W reaches the position corresponding to the intermediate winding point Pm that has been set in advance, the elongated workpiece W abuts against the detector 24 and pushes the detector 24, so that the detector 24 is moved by this pressure.

In this way, the detector 24 becomes the accommodated state, the engagement between the detector 24 and the wire holder 22 is released, and the wire holder 22 swings in synchronization with the detector 24 and moves to the second swing position P2. Accordingly, in the winding region 29, the leading end of the binding wire T is moves to the side toward the end frame 12*b* from the intermediate winding point Pm.

As a result, the leading end of the binding wine T is placed at a position contacting the elongated workpiece W that has been wound, and the binding wire T is inserted between the previously wound elongated workpiece W and the subsequently wound elongated workpiece W. In this state, the elongated workpiece W to be further supplied is sequentially wound around the drum 12.

When the elongated workpiece W is wound and reaches the end frame 12*c*, the elongated workpiece W is supplied to overlap the outer periphery of the previously wound portion of the elongated workpiece W, and is sequentially arranged and wound in the opposite direction from the end frame 12*c* toward the end frame 12*b*.

At the intermediate winding point Pm, the leading end of the binding wire T is protruded to the outer peripheral side through the adjacent portions of the elongated workpieces W. Therefore, the leading end of the binding wire T is automatically bent by the elongated workpiece W to be sequentially wound, and is arranged to protrude from the end frame 12*b*.

Thereafter, when the elongated workpiece W is wound up to the end frame 12*b*, the binding wire T is inserted and held between the portion of the elongated workpiece W wound on the inner side and the portion of the elongated workpiece W wound on the outer side. In this state, the leading end of the binding wire T is placed in a state of being exposed toward the end frame 12*b*.

The elongated workpiece W is further arranged and wound on the peripheral side again from the end frame 12*b* to the end frame 12*c*. By repeating this, the entire length of the elongated workpiece W is wound to form a coil.

After the coil is formed, the leading end of the binding wire T is protruded from the end frame 12*b*. The other end of the binding wire T is protruded to the side of the binding wire inserting device 20. Accordingly, by tying the other end to the leading end, the first several turns of the elongated workpiece W can be bound by the binding wire T. In this way, the winding of the elongated workpiece W is completed.

According to the binding wire inserting device 20 and the elongated workpiece winding apparatus 10 described above, the binding wire T is held in the wire holder 22 in a state in which the leading end of the binding wire is protruded from the wire holder, and the wire holder 22 is swung from the first swing position P1 to the second swing position P2.

Therefore, the leading end of the binding wire T is moved from one side to the other side of the intermediate winding point Pm.

Accordingly when winding the elongated workpiece W multiple times around the drum 12, the wire holder 22 is held in the first swing position P1 until the elongated workpiece reaches the intermediate winding point Pm. Then, the wire holder 22 is swung to the second swing position P2 when the elongated workpiece reaches the intermediate winding point Pm. In this way, the binding wire T can be easily inserted at the intermediate winding point Pm in the bundle of the elongated workpiece W that has been wound.

As a result, it is possible to easily insert, with a simple structure, the binding wire T at the intermediate winding point Pm of the elongated workpiece W during the winding.

In the inserting device 20 and the winding apparatus 10, the wire holder 22 includes the magnet 27, and the binding wire T is held by being magnetically attached to the magnet 27. Accordingly, the binding wire T can be easily held in a predetermined direction on the wire holder 22 just by abutting the lateral face of the binding wire T against the surface of the holding portion 26 of the wire holder 22. Further, after the binding wire T is inserted at the intermediate winding point Pm of the elongated workpiece W, the binding wire T can be released from the wire holder 22 without performing any releasing operation. Therefore, it is possible to easily perform the insertion operation of the binding wire T.

In the inserting device 20 and the winding apparatus 10, the detector 24 is provided to detect the elongated workpiece W at the intermediate winding point Pm and the wire holder 22 is swung from the first swing position P1 to the second swing position P2 when the detector 24 detects the elongated workpiece W. In this way, the wire holder 22 is automatically swung. As a result, it is possible to easily perform the insertion operation.

In the inserting device 20 and the winding apparatus 10, the biasing member 23 is provided to bias the wire holder 22 toward the second swing position P2, the detector 24 is arranged at a position on the drum 12 corresponding to the intermediate winding point Pm such that the detector 24 is allowed to protrude from the drum and to be accommodated in the drum, and the detector 24 in the protruded state is engaged with the wire holder 22 in the first swing position P1. Accordingly, the engagement of the detector 24 is released and the wire holder 22 is swung to the second swing position P2 when the elongated workpiece W wound around the drum 12 abuts against the detector to move the detector 24 to the accommodated state.

Therefore, a driving mechanism for operating the wire holder 22 is not required, and the binding wire T can be automatically inserted at the intermediate winding point Pm in the bundle of the elongated workpiece W that has been wound, with a very simple structure.

The foregoing embodiment may be modified within the scope of the present invention.

For example, while the elongated workpiece W to be wound is a steel rod having a circular cross-section in the example described above, the elongated workpiece W is not particularly limited. Similarly to the example described above, the present invention may be applied to a case in which a cross-section of the elongated workpiece has a polygonal shape or an irregular shape, or to a case in which the elongated workpiece is made of a different material.

Further, while the wire T is inserted in the intermediate point in the bundle of the elongated workpiece W that has been formed by winding one elongated workpiece W multiple times in the example described above, the present invention may be similarly applied to a case in which the wire T is inserted in the intermediate point when forming a bundle of a plurality of elongated workpieces W. For example, when placing a plurality of linearly extending elongated workpieces W on a placement table, a guide member or the like, the inserting device may be provided on the placement table or on the guide member.

Further, while the wire T is made of a magnetic material such as steel rod or the like in the example described above, the material of the binding wire T is not particularly limited. For example, the wire may be made of resin, non-ferrous metal, etc., that has strength capable of binding a given location on the bundle of the elongated workpiece W. When the wire T to be inserted is not used for binding, a wire having suitable strength may be selected depending on use.

Further, while the wire T is supported by the magnet 27 in the example described above, the manner of supporting the wire T may be modified as appropriate. For example, the wire T may be releasably supported by an elastic member, an adhesive material or the like. Alternatively, the wire T may be supported by supporting means configured to be mechanically opened and closed in accordance with the operation of the detector 24.

Further, while the drum 12 is rotated by a driving device in the example described above, the drum 12 may be configured such that the rotation drum is driven in accordance with the movement of the elongated workpiece W as the elongated workpiece W is moved in its axial direction.

Further, while a torsion coil spring is used as the biasing member 23 in the example described above, other biasing members may be used, in so far as the biasing member can bias the wire holder 22 toward the second swing position P2.

This application is based on Japanese Patent Application No. 2014-014972 filed on Jan. 29, 2014, the entire content of which is incorporated herein by reference.

The invention claimed is:

1. A wire inserting device for inserting a wire in a bundle of an elongated workpiece at an intermediate point in the bundle, the wire inserting device comprising:

a detector arranged at a position corresponding to the intermediate point; and a wire holder configured to releasably hold the wire, wherein the detector is configured to move when pushed by the elongated workpiece placed at the intermediate point during a formation of the bundle of the elongated workpiece, and wherein the wire holder is configured to move in synchronization with the detector to insert the wire in the bundle at the intermediate point such that the wire is sandwiched between portions of the elongated workpiece during the formation of the bundle.

2. The wire inserting device according to claim 1, wherein the detector is configured to detect the elongated workpiece when the elongated workpiece is placed at the intermediate point.

3. The wire inserting device according to claim 1, wherein the wire holder is configured to releasably hold the binding wire in a state in which a leading end of the binding wire is protruded from the wire holder and to swing between a first swing position and a second swing position, wherein, in the first swing position, the wire holder holds the binding wire such that the leading end of the binding wire is placed on one side of the intermediate point, and wherein, in the second swing position, the wire holder holds the binding wire such that the leading end of the binding wire is placed on the other side of the intermediate point.

4. The wire inserting device according to claim 3, wherein the detector is configured to detect the elongated workpiece when the elongated workpiece is placed at the intermediate point, and wherein the wire holder is operable to swing from the first swing position to the second swing position when the detector detects the elongated workpiece.

5. The wire inserting device according to claim 4, further comprising a biasing member configured to bias the wire holder toward the second swing position, wherein the detector is arranged to engage with the wire holder in the first swing position, and wherein, when the elongated workpiece abuts against the detector, the engagement of the detector is released and the wire holder swings to the second swing position.

6. A wire inserting method for inserting a wire in a bundle of an elongated workpiece at an intermediate point in the bundle, the wire inserting method comprising:

releasably holding the wire by a wire holder;

pushing and moving a detector by the elongated workpiece placed at the intermediate point during a formation of the bundle of the elongated workpiece, the detector being arranged at a position corresponding to the intermediate point; and moving the wire holder in synchronization with the detector to insert the wire at the intermediate point such that the wire is sandwiched between portions of the elongated workpiece during the formation of the bundle.

7. The wire inserting method according to claim 6, wherein during the pushing and moving operation, the detector detects the elongated workpiece when the elongated workpiece is placed at the intermediate point.

8. The wire inserting method according to claim 6, wherein the releasably holding the binding wire operation includes holding the binding wire in a state in which a leading end of the binding wire is protruded from the wire holder, and the moving the wire holder operation comprises, when the elongated workpiece is placed at the intermediate point, swinging the wire holder from a first swing position at which the leading end of the binding wire is placed on one side of the intermediate point to a second swing position at which the leading end of the binding wire is placed on the other side of the intermediate point.

* * * * *